United States Patent [19]

Brkic

[11] 4,130,306

[45] Dec. 19, 1978

[54] EXIT DOOR LOCKING MECHANISM HAVING MULTIPLE BOLTS

[75] Inventor: Ferdo Brkic, Los Angeles, Calif.

[73] Assignee: Adams Rite Manufacturing Co., Glendale, Calif.

[21] Appl. No.: 785,687

[22] Filed: Apr. 7, 1977

[51] Int. Cl.[2] ..... E05C 9/02; E05C 9/16

[52] U.S. Cl. ..... 292/5; 292/21; 292/335; 292/DIG. 65

[58] Field of Search ..... 292/5, 21, 36, 48, 92, 292/335, DIG. 65, 7, 26, 34; 248/410

[56] References Cited

U.S. PATENT DOCUMENTS

| | | | |
|---|---|---|---|
| 984,458 | 2/1911 | Witham | 292/21 |
| 1,130,266 | 3/1915 | Gold | 292/92 |
| 1,203,116 | 10/1916 | Hurd | 292/21 |
| 1,263,955 | 4/1918 | Stansbury | 248/410 |
| 1,505,220 | 8/1924 | Shay | 248/410 X |
| 2,785,914 | 3/1957 | Thomas et al. | 292/7 |
| 3,083,560 | 4/1963 | Scott | 292/21 X |
| 3,124,378 | 3/1964 | Jackson | 292/5 |
| 3,149,864 | 9/1964 | Foster | 292/21 |
| 3,334,500 | 8/1967 | Bejarano | 292/21 X |
| 3,993,335 | 11/1976 | Schmidt | 292/21 |
| 4,015,866 | 4/1977 | Marsh et al. | 292/36 |

FOREIGN PATENT DOCUMENTS

| | | | |
|---|---|---|---|
| 574903 | 4/1924 | France | 292/5 |

*Primary Examiner*—Roy D. Frazier

*Assistant Examiner*—William E. Lyddane

*Attorney, Agent, or Firm*—Whann & McManigal

[57] ABSTRACT

A panic exit door locking mechanism adapted particularly for mounting on a narrow stile door frame, and which includes top and bottom bolt mechanisms respectively at the upper and lower ends of the tubular frame at the swinging edge of the door, the locking instrumentalities including a rotatable lever arrangement concealed within the tubular stile, and being connected to the bolt mechanisms by concealed rod structures that are length adjustable for doors of different heights. Actuators for the rotatable lever arrangement comprise a manually operable panic exit actuator device mounted on the inner side of the door and/or a conventional key-controlled rotatable cam lever having a lost motion relation with the rotatable lever arrangement. The bottom bolt mechanism has a conventional reciprocable bolt, while the top bolt mechanism has a fixed bolt mounted on the door header, this bolt being utilized to actuate associated latching mechanism carried by the door to a bolt-latching position when the door is closed, and to a non-latching position when the door is open, movements of the latching mechanism being further utilized to control the operation of associated dogging members so as to dog the latching mechanism with respect to the top bolt, when the door is closed, and to dog the bottom bolt in retracted position when the door is opened.

23 Claims, 8 Drawing Figures

EXIT DOOR LOCKING MECHANISM HAVING MULTIPLE BOLTS

BACKGROUND OF THE INVENTION

The present invention relates generally to the field of safety exit doors, and locking mechanisms therefor.

It has heretofor been known generally to provide panic exit doors with top and bottom conventional reciprocably mounted bolts which are arranged to be normally maintained in an extended bolted position, when the door is closed. In the known structures, the bolts are arranged to be actuated by a panic actuator device mounted on the inside of the door for emergency operation to move the top and bottom bolts to retracted release position so as to enable the door to be swung to an open position.

Such structures are disclosed, for example, in U.S. Pat. Nos. 3,334,500 and 3,663,047, and which, according to the prevailing usual practice, utilize reciprocably mounted top and bottom bolts that are carried by the door structures, these bolts being arranged to enter keeper recesses in the door frame header and the threshold structures.

While bolts of the reciprocable type are well suited for locking mechanisms on conventional doors, it has been found that in the case of panic exit doors excessive and undesirable operating loads may develop under certain conditions. In panic exit door installations, crowding of persons at the door during uncontrolled panic conditions may result in the application of abnormally high pushing forces against the inside of the door, and as a result high friction load forces on the bolts may indeed be so great as to seriously affect, and under some conditions make it virtually impossible to retract the bolts by operating the panic bar actuating device on the inside of the door.

The present invention proposes to solve this difficulty by providing a simplified and unique lock mechanism by reducing the number of reciprocably mounted bolt structures. Instead, only one reciprocable bolt is provided at the bottom of the door, and at the top of the door a fixed header bolt is utilized for controlling an associated releasable latching means which can be dogged in a latched position with respect to the top bolt, and which is also used to effectively dog the bottom bolt in its retracted position. In the present invention, the bolt mechanisms and their connections to the actuators, as well as the elements for dogging the bolts, are all mounted and concealed within the stile frame member at the swinging edge of the door in a manner which permits greater flexibility and adaptation of actuating devices which may embody a key-controlled lock cylinder as well as panic bar actuator devices.

SUMMARY OF THE INVENTION

The present invention is more specifically concerned with improvements in locking mechanisms for panic exit doors, which have multiple bolt arrangements, and in particular with respect to the bolt mechanisms and the actuating means therefor.

It is one object of the present invention to provide an improved lock mechanism for exit doors, in which ease of operation will be assured under panic conditions, and wherein the bolt operating components are hidden within a tubular frame member at the swinging edge of the door, the bolt operating components being adapted for operation either by key-controlled or by a panic exit actuator device mounted on the inner side of the door frame.

A further object is to provide a unique locking mechanism for exit doors having top and bottom lock mechanisms that are operable through reciprocable connecting rod structures which are longitudinally adjustable in order that the locking mechanism may be quickly and easily adapted to fit doors of different height.

A further object resides in the provision of a locking mechanism for an exit door in which the bolt mechanisms and actuating components are hidden within th tubular frame stile of the swinging edge of the door, and are mounted on a common wall of the stile, so as to thereby permit use of the locking mechanism with stiles of different depth and width dimensions.

Another object is to provide in an exit door lock mechanism, a unique rotatable rotary lever means for the actuation of top and bottom bolt mechanisms and wherein the lever means comprises a pair of oppositely extending arms pivoted on adjacently spaced axes of rotation, and wherein the arms are interconnected for unitary actuation by an associated driving element, and wherein the arms are drivingly interconnected by mechanical means which will produce a great arc of movement in one of the pivot arms than in the other.

Still another object is to provide a top bolt mechanism in an exit door, which utilizes a fixed bolt and latching means which latchingly engages with the bolt, in which the bolt serves to move the latch to latched position when the door is closed, and a non-latched position when the door is opened; in which a dogging member dogs the latch in latching position when the door is closed, and in which operation of the latching means also serves to dog the bottom bolt in its retracted position.

It is also an object to provide the above described top bolt mechanism with a fixed bolt and latching member which are so conformed that they will interlock in the latched position in such a manner as to prevent their being vertically separated by means of a pry bar inserted between the top of the door structure and the header structure.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only.

DESCRIPTION OF A PREFERRED EMBODIMENT

Figure 1:
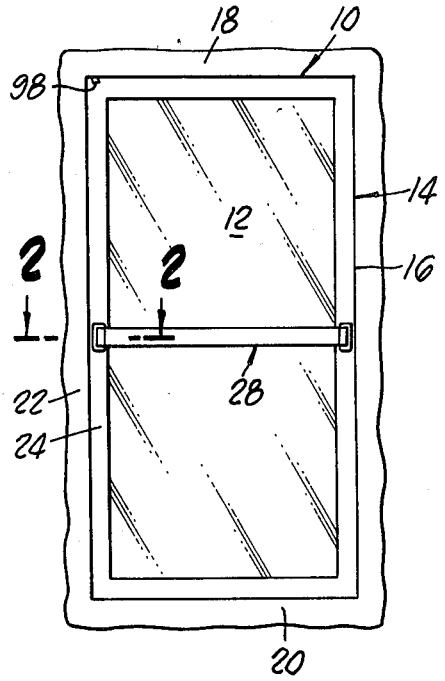
FIG. 1 is an inside elevational view of an exit door with a locking mechanism having multiple bolts according to the present invention, and including a panic actuating device mounted on the inside of the door.
Figure 2:
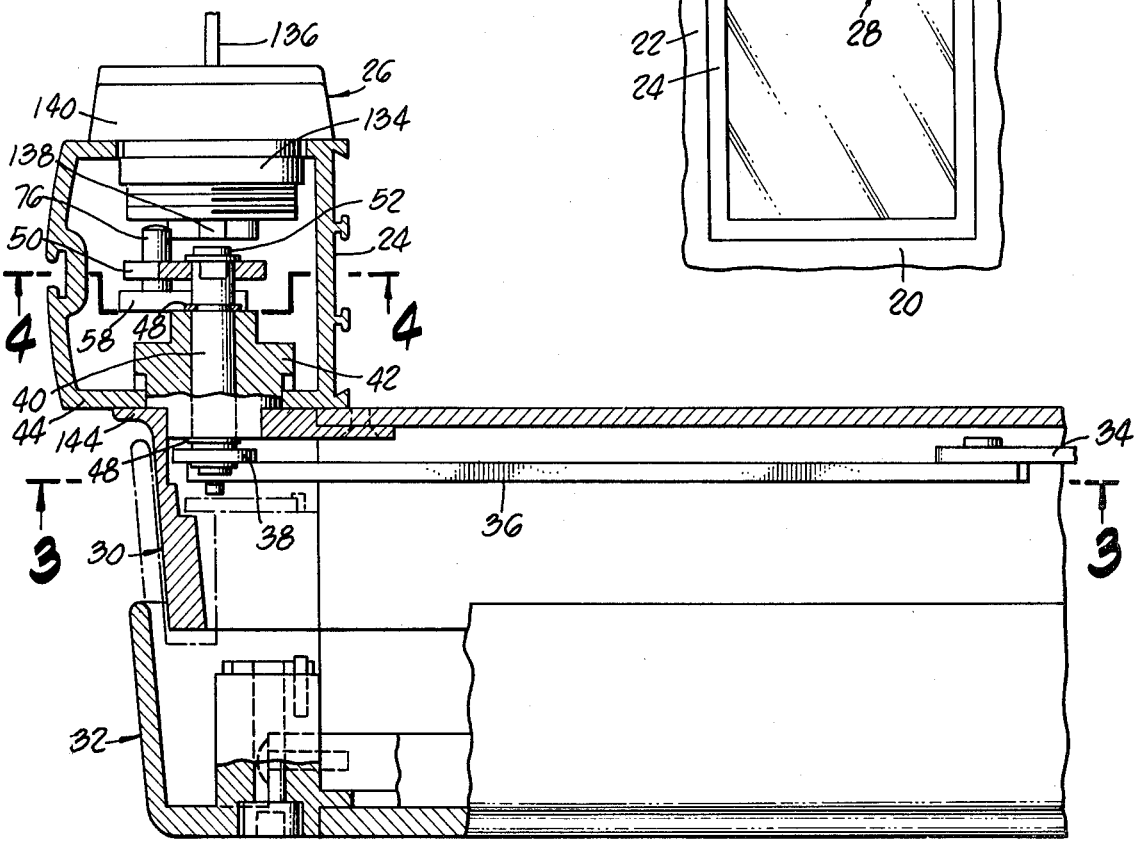
FIG. 2 is an enlarged horizontal section of an end portion of the panic actuator device and associated key-controlled actuator device for selectively operating the multiple bolts, taken substantially on line 2—2 of FIG. 1.

For illustrative purposes, there is disclosed in FIG. 1 an exit door, as generally indicated by the numeral 10, of conventional construction in which a glass panel 12 is shown and being mounted within a surrounding narrow stile tubular frame 14. The door is conventionally hinged at its inner edge 16 for swinging movement within a door opening having a top header 18, bottom threshold 20, and in this case a door frame 22 extending along the tubular frame 24 at the swinging edge of the door. While only one exit door is shown in this case, it is to be understood that the door opening may be of a size to operably receive a pair of swinging doors having their swinging edges adjacently disposed. The door embodies a locking mechanism having multiple bolts according to the present invention, which are arranged for selective operation by means of key-controlled means 26, shown as being mounted on the outside of the tubular frame 24 (FIG. 2) or by a panic bar actuator device, as generally indicated by the numeral 28, which is mounted on the inside of the door in spanning relation to extend between the door frame members at the hinged and swinging edges thereof.

Figure 3:
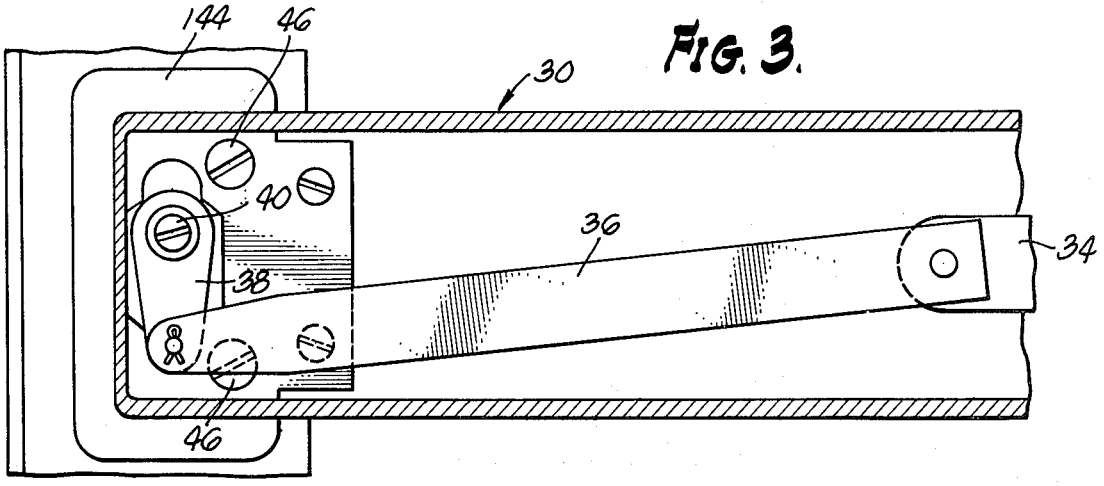
FIG. 3 is an enlarged fragmentary vertical sectional view taken substantially on line 3—3 of FIG. 2, showing the actuating connection with the linkage system of the associated panic bar actuator.
Figure 5:
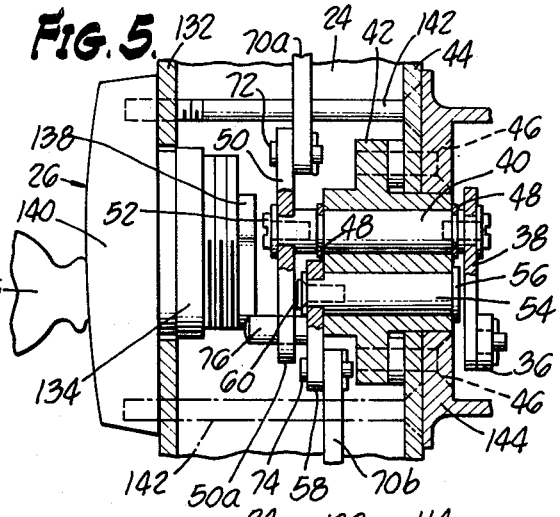
FIG. 5 is a fragmentary vertical sectional view taken substantially on line 5—5 of FIG. 4, to show details of the rotatable lever means for actuating the multiple bolts.

The panic bar actuator device 28 may be of any conventional construction, but should preferably mechanically be so designed as to deliver a rotary movement to a motion delivery shaft. For illustrative purposes, the panic bar actuator device 28 basically conforms to that which is disclosed in a commonly owned pending application of R. J. Folger, Ser. No. 764,726, filed Feb. 2, 1977, which is incorporated herein by reference, and basically includes an elongate housing structure 30 and a coextensive exposed push-bar 32 which is supported for movement towards and away from the housing. The push-bar is connected through a connecting linkage (not shown) with a reciprocably mounted actuator element 34, such that when the push-bar is depressed the actuator element 34 will be moved towards the right, as viewed in FIG. 3. Spring means (not shown) normally urges the actuator element towards the left to a position as shown in FIG. 3. Reciprocable movements of the actuator element 34 are transmitted to an elongated connecting link 36 which is pivotally connected at one end with the actuator element, and at its other end is pivotally connected with a crank arm 38 which is affixed to and rotatable with a shaft 40. As best seen in FIG. 5, the shaft 40 is rotatably supported in a bearing bracket 42 which is mounted within the tubular stile frame member 24 and secured to its inner side wall 44 by means of mounting screws 46. The shaft 40 is axially retained in the bearing bracket by means of snap rings 48 at its opposite ends.

The inner end of the shaft 40 non-rotatably mounts a lever arm 50 which is retained thereon by a retaining screw 52 threaded into the end of the shaft. The bearing bracket 42 also provides a support for a rotatable shaft 54 which is positioned immediately below and in spaced relation to the shaft 40, the shaft 54 having a headed portion 56 at its outer end, and at its innermost end being non-rotatably connected with a lever arm 58 which is retained on the shaft by a retaining screw 60 threaded into the end thereof.

Figure 4:
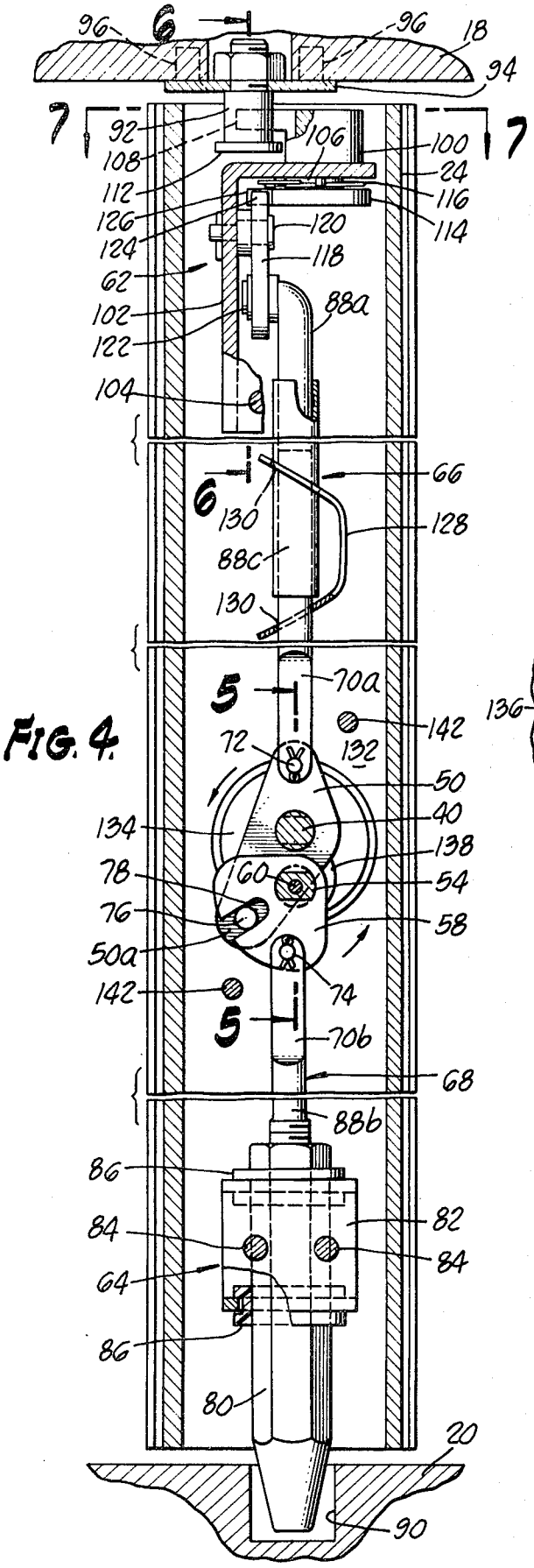
FIG. 4 is a transverse sectional view taken substantially on line 4—4 of FIG. 2, showing the details of the multiple bolt structures and actuating components contained within the tubular frame stile at the swinging edge of the door.

The lever arms 50 and 58 provide rotatable lever means for the actuation of a top bolt mechanism, as generally indicated by the numeral 62, and a bottom bolt mechanism, as generally indicated by the numeral 64, these bolt mechanisms being respectively connected with the lever means by connecting rod structures 66 and 68, as best shown in FIG. 4. The rod structure 66 has a lower rod section 70*a* which is connected by a pivot pin 72 with the outermost end of lever arm 50, and the rod structure 68 has a rod section 70*b* which is connected by a pivot pin 74 with the outermost end of the lever arm 58. The effective lengths of the lever arms 50 and 58 are the same. However, due to the fact that the top bolt mechanism and the bottom bolt mechanism have different operating characteristics, the lever arms are required to move their respective connected rod sections different distances. For a given movement of the rod section 70*a*, the rod section 70*b* must move a relatively greater distance. This difference in movement of the rod sections is accomplished by providing a mechanical interconnection between the lever arm 50 and the lever arm 58, which will increase the arc of travel of pivot pin 74 in relation to the arc of travel of the pivot pin 72. This may be accomplished in various ways, but is illustrated in FIG. 4 as comprising a second lever arm 50*a* which is integrally formed with the lever arm 50 and carries a pin 76 at its outermost end, this pin having a radial spacing from the axis of shaft 40 which is greater than the radial spacing of the pivot pin 72. The pin 76 is movable in a radial slot 78 which is formed in a portion of the lever arm 58.

As best shown in FIG. 4, the bottom bolt mechanism 64 comprises a bolt 80 which is formed from a hexagonal extrusion. This bolt is guidingly supported for vertical reciprocal movements in a U-shaped bracket 82 which is secured as by screws 84 to the inner side wall 44. Preferably, the bolt 80 is supported in the bracket arms by suitable bushings 86 of nylon or other suitable material. The uppermost end of the bolt 80 is threadedly engaged with the lower end of a rod section 80*b* of the connecting rod structure 68. The lowermost end of the bolt 80 is beveled, and arranged in the bolt extended position to seat within a keeper recess 90 formed in the door threshold 20.

The top bolt mechanism 62, as best shown in FIGS. 4 and 6–8, comprises a bolt 92 which is secured to an attaching plate 94, this attaching plate being secured to the top header as by screws 96 so as to project downwardly therefrom into the path of travel of the upper end of the tubular frame member 24, a notch 98 being provided at the upper end of the wall 44 to permit passage of the bolt into the frame member as the door moves into a closed position.

Figure 7:
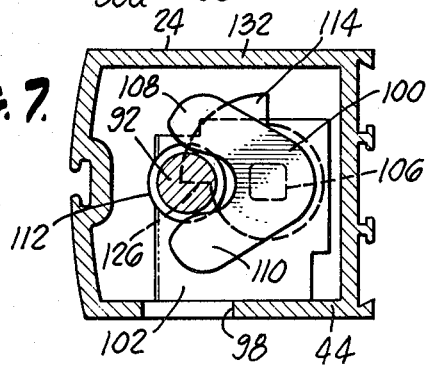
FIG. 7 is a transverse sectional view taken substantially on line 7—7 of FIG. 4, to show the latching position of the latching member with the bolt at the top of the door.
Figure 8:
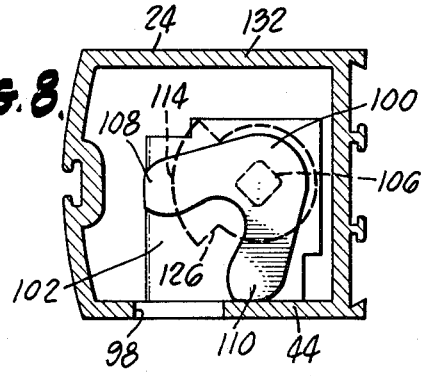
FIG. 8 is a similar view showing the latching member in a non-latching position with respect to the bolt.

Latching means are provided for operative association with the bolt 92, and comprises a latching member 100 which is mounted upon an upper supporting bracket 102 that is secured to the inner side wall 44 as by screws 104. The latching member is mounted on a rotatable shaft 106 which provides a vertical axis of rotation for the latching member. As shown in FIGS. 7 and 8, the latching member is formed with radially diverging fingers 108 and 110 which are engageable by the bolt 92 during opening and closing movements of the door, the bolt during closing movement of the door operating to swing the latching member to a latching position relative to the bolt, as shown in FIG. 7, and during opening movement of the door operating to rotate the latching member to a non-latching position as shown in FIG. 8. It will be observed that in the latching position, as shown in FIG. 7, a head flange 112 on the bolt is positioned so as to underlie adjacent edge portions of the fingers 108 and 110. Thus, the bolt and latching member are interlocked in such a manner that they cannot be vertically separated by the insertion of a pry-bar between the top header and the upper end of the door. A high degree of security is thus provided with this type of bolt mechanism.

Dogging means are provided for dogging both the top bolt mechanism and the bottom bolt mechanism for certain of their operating conditions. In the case of the top bolt mechanism, the lowermost end of the shaft 106 is connected with a dogging plate 114 which is rotatable in a horizontal plane in unison with the rotative movements of the latching member 100. A coiled spring 116 connected between the bracket 102 and the dogging plate functions to normally urge the latching member 100 towards the non-latching non-dogged position, as shown in FIG. 8.

Figure 6:
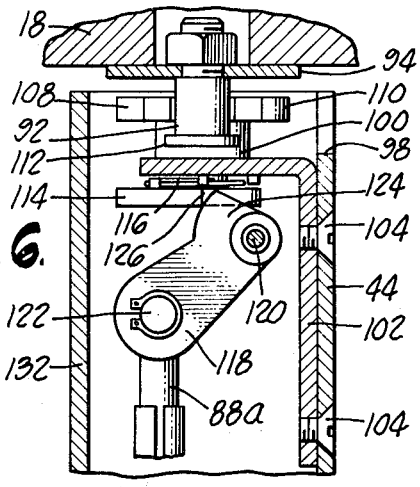
FIG. 6 is a fragmentary vertical sectional view taken substantially on line 6—6 of FIG. 4, showing details of the dogging means.

A shown in FIGS. 4 and 6, a dogging lever 118 is pivotally mounted on a pivot pin 120 below the path of movement of the dogging plate 114, which permits swinging movement of the dogging lever in a vertical plane. The free end of the dogging lever is pivotally connected at 122 with the upper end of a rod section **88*a* of the connecting rod structure 66. Moreover, the dogging lever 118 is provided adjacent its pivoted end with a projecting nose portion 124 which is adapted to normally seat in a dogging position behind an abutment edge 126 on the abutment plate 114, when the latching member 100 is in a latching position with reference to the bolt 92, and when the rod structures 66 and 68 have been moved apart to a locking position by the action of the lever arms 50 and 58 due to the urging force of the spring means of the associated panic bar actuator device 28, this spring acting through the connecting link 36 and crank arm 38 to rotate the shaft 40 and the connected lever arms into a bolt locking position. In this position, as will be noted in FIG. 4, the pivot pins 72 and 74 will be disposed in an over-center position with respect to a vertical axis through the centers of the shafts 40 and 54**.

In order to open the door, the lever arms will be rotated in a counter-clockwise direction, as viewed in FIG. 4, either by depressing the push bar 32 of the panic bar actuator device 28, or by the actuation of the connected key-controlled means 26, when used. As a result of this operation, the bottom bolt 80 will be retracted from the recess 90, and the nose portion 124 withdrawn from behind the abutment edge 126. The door is now free to be opened, and as it is moved from closed position, the latching member 100 will be moved by the bolt 92 to a non-latching position as shown in FIG. 8. In this position, the nose 124 will be in a position of engagement with the under surface of the dogging plate 114, and this plate will restrain the lever arms and connected rod structures against movement in a direction which would tend to extend the bolt 80 into its extended position. Thus, the bolt 80 is dogged in its retracted position and cannot be moved to an extended position until the door is again moved into closed position so as to shift the dogging plate 114 to a position which will permit the nose 124 to again seat behind the abutment edge 126.

From a consideration of the locking mechanism as thus far described, it will be apparent that the mounting positions of the top and bottom bolt mechanisms will be dimensionally fixed with respect to the top header 18 and the bottom threshold 20, and that the length of the connecting rod structures 66 and 68 will be different for doors of different heights. It is, therefore, a feature of this invention to provide connecting rod structures which may be suitably adjusted to accommodate the locking mechanism for doors of different height dimensions. For this purpose, similar means are provided for adjusting each of the connecting rod structures, and such means has been illustrated in connection with the connecting rod structure 66, as shown in FIG. 4. The same adjusting means will also be provided in connection with the rod structure 68. More specifically, the rod section **88*a* is provided with a sleeve extension 88*c* of a size to receive the adjacent end of the rod section 70*a* in telescopic relation to form a slip-joint connection therebetween. A bowed spring 128 is formed with openings 130** at its ends, which are adapted to receive and grippingly engage the respective rod sections at the joint when the bowed spring is positioned in spanning relation over the joint. The spring may be released with respect to the gripped sections, for the purpose of adjusting the joined sections, merely by pressing the spring ends towards each other.

While the above described adjusting means will be used for major adjustments of the connecting rod structures to accommodate the mechanism for doors of different height, it will be noted that minor adjustments of the bolt 80 are possible simply by rotating the bolt in one direction or the other on its threaded connection with the rod section **88*b***.

The key-controlled means 26 is shown as being mounted on the inner side wall 132 of the tubular frame member 24, to provide an authorized actuator on the outer side of the door to permit the locking mechanism to be unlocked, when desired, from the outside. As shown, the key-controlled means is of conventional construction and comprises a tumbler lock cylinder 134 adapted for actuation by means of a suitable key 136 to rotate an operably associated cam lever 138 into engagement with the pin 76, and thereby rotate the lever arms 50 and 58 in the appropriate direction to unlock the top and bottom bolt mechanisms. The cam lever 138 has lost motion relation with respect to the pin 76.

As will be seen, the tumbler lock cylinder is mounted on an exterior mounting plate 140 (FIG. 5), this plate being secured in position by mounting screws 142 which extend between the side walls 44 and 132 of the tubular frame 24, and with the screw head portions seated in the wall 44 where they are covered by an end cap 144 of the panic bar actuator device 28.

From the foregoing description and drawings, it will be clearly evident that the delineated objects and features of the invention will be accomplished.

Various modifications may suggest themselves to those skilled in the art without departing from the spirit of my invention, and, hence, I do not wish to be restricted to the specific forms shown or uses mentioned, except to the extent indicated in the appended claims.

I claim:

1. A lock mechanism for an exit door having a tubular stile frame member extending along its swinging edge, and with top and bottom bolt mechanisms, comprising:

(a) lever means positioned in the tubular stile, including a pair of separate rotatably mounted levers;

(b) connecting rod structures in the stile respectively connecting said levers with the top and bottom bolt mechanism, the bottom bolt mechanism including a bolt mounted for reciprocable movement and the top bolt mechanism includes a fixed member on the frame and a horizontally swingable latch member mounted on the door to be engaged with said fixed member when the door is in a closed position, said latch member being swingable into a released position with respect to said fixed member to permit the door to be opened;

(c) a driving connection between said levers;

(d) said lever means being normally operative in one direction to axially move said rod structures away from each other to effect one operating condition of the bolt mechanisms; and (e) manually operable means accessible from one side of the door for rotating one of said levers and the connected other lever of the levers as a unit in an opposite direction to axially move said rod structures towards each other to effect another operating condition of the bolt mechanisms.

2. A lock mechanism as set forth in claim 1, in which the manually operable means includes a key-controlled rotatable cam lever having a lost motion operative relation with one of said levers.

3. A lock mechanism as set forth in claim 1, in which the manually operable means includes a depressable push bar mounted on the inner face of the exit door and being operatively connected with one of said levers.

4. A lock mechanism as set forth in claim 1, in which the rod structures include means for adjusting their length to fit doors of different heights.

5. A lock mechanism as set forth in claim 4, in which each rod structure includes rod sections with adjacent ends connected by a telescoping slip joint; and in which the adjusting means includes a bowed spring for clampingly retaining the joined sections in adjusted connected position for unitary movement, said spring having openings at its ends for respectively receiving portions of the joined rod sections therethrough and being normally urged into gripped engagement therewith, the spring being releasable with respect to the joined sections when the spring ends are moved towards each other.

6. A lock mechanism as set forth in claim 1, in which said lever means, rod structures and the associated parts of the top and bottom bolt mechanism are all mounted on a common wall of the tubular stile frame member, whereby to permit the use of stiles of different dimensions.

7. A lock mechanism as set forth in claim 1, in which one of said levers is a double ended lever in which one arm extends in a substantially opposite direction than the other arm and the other of said lever has a single arm, and in which the operative lengths of said single arm and said other arm are substantially equal and are operative through said driving connection to relatively axially move the rod structure connected with the lower bolt mechanism a greater distance than the corresponding movement of the rod structure connected with the top bolt mechanism.

8. A lock mechanism as set forth in claim 7, in which the levers are mounted on spaced apart parallel pivotal axes, and said driving connection is mechanically operative to increase the effective relative travel swinging movement of said single arm with respect to said other arm.

9. A lock mechanism as set forth in claim 1, in which the bottom bolt mechanism reciprocable movements include extended and retracted positions.

10. A lock mechanism as set forth in claim 9, in which the fixed member comprises a bolt mounted on an associated door frame top header.

11. A locking mechanism as set forth in claim 9, in which the top bolt mechanism includes means operable by said fixed bolt member in response to movement of the door out of a closed position, to deadlock the bottom bolt mechanism in its retracted position.

12. A lock mechanism as set forth in claim 11, in which the fixed bolt member projects downwardly from the associated door header, 13. A lock mechanism as set forth in claim 12, in which said fixed bolt and said latch member have portions adapted to vertically interlock in the closed position of the door, so as to prevent relative vertical separation of the bolt and latch member by means of a pry bar inserted between the door header and the top frame of the door.

14. A locking mechanism as set forth in claim 13, in which the interlocking portion of the fixed bolt comprises a head flange which is adapted to extend under an edge forming interlocking portion of the associated latch member.

15. A lock mechanism as set forth in claim 12, in which dogging means including a vertically swingable dogging member connected with the rod structure of the top bolt mechanism is operable to a dogging position with respect to the horizontally swingable bolt latching member, when the latching member is moved by the bolt to said latching position.

16. A lock mechanism as set forth in claim 15, in which said bolt latching member is normally spring urged in its horizontal swinging movement towards its non-latching position.

17. A lock mechanism as set forth in claim 15, which further includes a horizontally swingable element actuatable in response to the movement of the latching member to its non-latching position, for holding the dogging member in a non-dogging position with respect to the top bolt mechanism and also operate through the interconnected rod structures to dog the bolt of the bottom mechanism in a released position.

18. A locking mechanism as set forth in claim 17, in which the bolt latching member is supported on a vertical pivotal axis and has horizontal outwardly diverging fingers adapted to coact with the bolt during door opening and closing movements, and in a door closed position one of said arms occupying a latching position opposing movement of the door from its closed position; in which said element comprises a flat plate underlying the latching member and being connected for horizontal pivotal movement therewith; and in which the dogging member comprises a lever below said element having one end supported for swinging movement on a horizontal pivotal axis and its other end connected to the associated rod structure, said dogging lever having a nose portion adapted in the dogging position to extend past an edge of the plate member to oppose movement of the latching member by the bolt to a non-latching position; and said nose portion in a non-latching position of said latching member being adapted to engage against the undersurface of the flat plate and thereby oppose movement of the rod structures in a direction away from each other, and thus dog the bottom bolt in its retracted position.

19. A lock mechanism as set forth in claim 19, in which one of said levers is a double ended lever in which one arm extends in a substantially opposite direction than the other arm and the other of said levers has a single arm, and the effective lengths of said single arm and said other arm are substantially equal; and said driving connection includes an overlapping relationship between said single arm and said one arm, and a pin and slot connection.

20. A lock mechanism as set forth in claim 19, in which the pin is carried by said one arm, and the slot is formed on said single arm.

21. A lock mechanism as set forth in claim 20, in which the effective operative length of said one arm is greater than the respective effective lengths of said single arm and said other arm.

22. A lock mechanism as set forth in claim 1, in which the manually operable means includes a key-controlled rotatable cam lever movable between said single arm and said one arm in an operative path of engagement with said pin.

23. A lock mechanism as set forth in claim 19, in which the manually operable means includes a depressable push bar operatively connected to rotate said double ended lever.

* * * * *

UNITED STATES PATENT OFFICE

CERTIFICATE OF CORRECTION

Patent No. 4,130,306 Dated December 19, 1978

Inventor(s) Ferdo Brkic

It is certified that error appears in the above-identified patent and that said Letters Patent are hereby corrected as shown below:

Claim 11, line 1, change "9" to -10-.

Claim 12, line 1, change "11" to -10-.

Claim 19, line 1, change "19" to -1-.

Claim 22, line 1, change "1" to -19-.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*